US005431252A

United States Patent [19]

Morrison

[11] Patent Number: 5,431,252

[45] Date of Patent: Jul. 11, 1995

[54] METHOD FOR DIGITAL RECORDING AND GRAPHIC PRESENTATION OF THE COMBINED PERFORMANCES OF ELEVATOR CARS

[75] Inventor: Jeffrey E. Morrison, Newtown Square, Pa.

[73] Assignee: Performance Profiles Inc., Merion Station, Pa.

[21] Appl. No.: 149,377

[22] Filed: Nov. 9, 1993

[51] Int. Cl.[6] ..... B66B 5/00

[52] U.S. Cl. ..... 187/394; 187/391; 187/397

[58] Field of Search ..... 187/130, 133, 134, 137, 187/100, 391, 393, 397, 399, 394

[56] References Cited

U.S. PATENT DOCUMENTS

| | | | |
|---|---|---|---|
| 3,781,901 | 12/1973 | Morrison | 346/33 R |
| 4,002,972 | 1/1977 | Konrad et al. | 324/73 R |
| 4,401,192 | 8/1983 | Trosky et al. | 187/29 R |
| 4,458,788 | 7/1984 | LePore | 187/130 |
| 4,536,842 | 8/1985 | Yoenda et al. | 364/424 |
| 4,750,591 | 6/1988 | Coste et al. | 187/130 |
| 4,874,063 | 10/1989 | Taylor | 187/130 |
| 5,202,540 | 4/1993 | Auer et al. | 187/101 |
| 5,283,339 | 2/1994 | Fujino et al. | 187/124 |

FOREIGN PATENT DOCUMENTS

| | | | |
|---|---|---|---|
| 1-81686 | 7/1989 | Japan | 187/100 |
| 1-308376 | 12/1989 | Japan | 187/130 |
| 3-195678 | 8/1991 | Japan | 187/130 |
| 5-24762 | 2/1993 | Japan | 187/130 |

*Primary Examiner*—Steven L. Stephan
*Assistant Examiner*—Robert Nappi

[57] ABSTRACT

A method for sensing and digitally recording the movements of a plurality of elevator cars in conjunction with the sensing and digital recording of a plurality of on-off electrical signals from the associated elevator control system utilizing a portable computer. A separate analysis computer is then used to integrate such recorded information into a graphic presentation for the purpose of evaluating elevator system operation.

1 Claim, 5 Drawing Sheets

METHOD FOR DIGITAL RECORDING AND GRAPHIC PRESENTATION OF THE COMBINED PERFORMANCES OF ELEVATOR CARS

This invention is in the field of elevators and, in particular, to a method for digitally recording and producing a graphic analog presentation of the performance of elevator systems which contain many cars that are interrelated by a master control.

Past performance studies have provided the data and understanding that allow planners to accurately identify the types of problems that can occur in elevator systems in large buildings. The variables and common problems that can arise are, in part, listed below:

1. Missed calls or continuous calls, by malfunction
2. The inability to reverse direction, except at terminals
3. Car controls cancelling corridor calls; or missing stops
4. The inability of car controls to recognize corridor calls in another nearby zone
5. Control errors because of malfunctioning sensors
6. Particular cars that favor certain floors because of usage patterns
7. Time waste because of excessive levelling time or door dwell time
8. Time lost because of inadequate acceleration or deceleration rates A major objective of this invention is to provide elevator system operation data in an easy to interpret graphic presentation, that can show all of the variables listed above in a continuous time related chart; and which also clearly shows the interrelation of the many cars in the system.

It is another objective of this invention to provide a portable digital recording and graphic presentation method, which can encompass a complete elevator system operation; and which can be used on all types of elevators, regardless of age, size, or manufacture.

It is still another objective of this invention to provide all of the sensing, recording, computer formatting and read-out functions for an integrated graphic presentation, with up to date digital elements.

The use of computer compatible digital elements add noise immunity, improved accuracy, and greater dependability over analog based systems; such as our own original analog system U.S. Pat. No. 3,781,901.

BACKGROUND

Pertinent prior art systems include U.S. Pat. No. 4,002,973, "Elevator Testing System", which produces "artificial control signals", which are used with a volt-/ohm meter to check the continuity of the various electromechanical contacts in the elevator control system. This patent does not contain any of the basic elements of the new invention.

Another prior art U.S. Pat. No. 4,401,192, "Method of Evaluating the performance of an Elevator System", provides an elaborate "simulator system which simulates the operation of an elevator system having the same building configuration, number of elevator cars and which generates data that is representative of the proper response of the elevator system" . . . .

This system does not anticipate the use of a digitally produced graphic output presentation, such as the new invention, which shows the interaction of many cars in the system.

There is U.S. Pat. No. 4,750,591, "Elevator Car Door and Motion Sequence Monitoring Apparatus and Method", which claims, essentially, "Apparatus for monitoring an elevator, comprising signal processing means, for monitoring the states of a plurality of two state parameter signals, each indicive of one of a corressponding plurality of elevator parameters . . ." This patent also does not anticipate the use of a graphic presentation to show the interrelated operation of a number of elevator cars; such as provided by the new invention.

The relative simplicity of the new all digital motion sensing; computer recording; and computer programmed graphic display will become more clear with the following Figures, Operational Description.

THE FIGURES

OVERVIEW OF ELEVATOR SYSTEM OPERATION

Most elvator traffic studies depend upon landing wait times as the sole source of information. While landing wait times are considered as being the ultimate indication of whether elevator service is adequate, this information alone is not enough to reveal all of the conditions; since there are so many variables that can affect waiting times.

An elevator system reacts to certain commands which are generated by people pushing buttons in the hallway or in an elevator car. Once a button is pushed, the system must respond by delivering a car to the proper location.

This process can involve decisions based upon a variety of factors, such as the relative position of each car to the call position, the direction each car is travelling at the time of the call, previously assigned calls, traffic density etc.

The new evaluation method utilizes the interaction of landing wait times and the positions of all the elevators as the basis for its recording and information presentation in a graphic format; which traces the exact path of each elevator and corridor call, so that the system performance can be easily observed and evaluated by a trained person.

SYSTEM OPERATION

Figure 1:
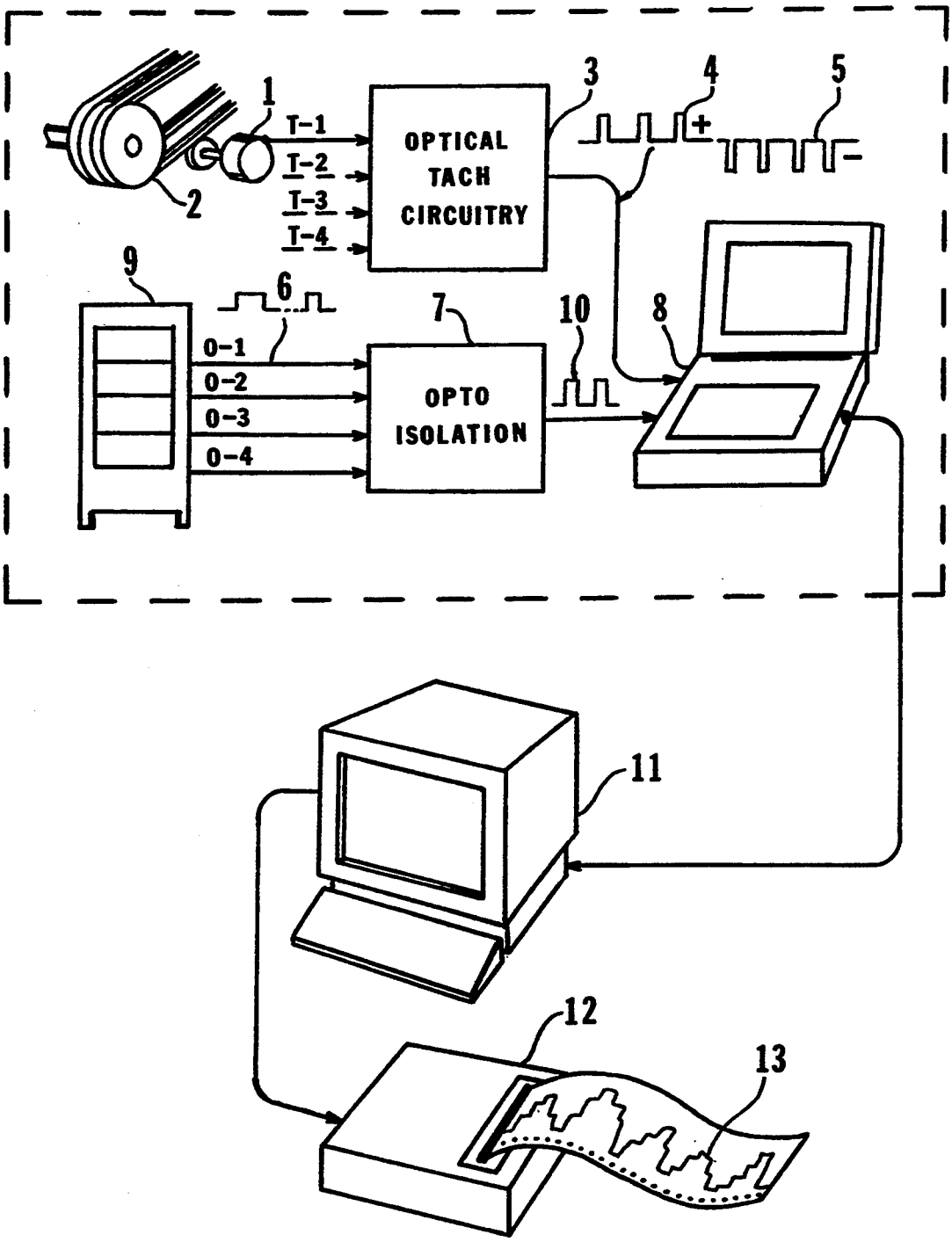
FIG. 1 shows a block diagram of the all digital system, with the multiple optical tachometers on the rotational drive equipment of many elevators; the optical isolation of on-off electrical signals from the master control; the portable computer for initial recording and signal processing for the off-line P.C. computer; and the Graphic display from the Printer/Plotter.

With reference to FIG. 1, the on-site and off-site components of the recording and playback system are shown with both system blocks and pictorial forms for clarity. Those system components that are usually located at the elevator site are shown within the dotted line box. Those components that can be utilized away from the elevator site are shown outside the dotted block.

Multiple optical tachometers 1 are used, in conjunction with the individual rotational drive equipment 2 for each elevator, to keep track of their vertical movement.

Digital output pulses (T1 to T4) from the tachometers 1 are supplied to the optical tachometer circuitry 3 which sends positive pulses 4 or negative pulses 5, depending on the direction of rotation, to the input of the recording computer 8. The recording Computer 8 has a built-in program to format the pulses 4,5 into position information, for each of the elevators. A plurality of on-off electrical signals 6 (0-1 to 0-4) from the elevator master control 9 which reflect the status of various electrical circuits such as hall call registrations, are isolated by the opto circuits 7 before being introduced to the portable recording computer 8. The standardized signals 10 are then integrated with the tachometer pulse information 4,5, and time base information in the portable computer 8, to form the basis for the time related analog waveforms 13 of the graphic presentation.

The P.C. Computer 11 can display all of the accumulated data from the small portable computer 8, and program all of the data into columnized format, suitable for printing on pages, with a printer/plotter 12. The P.C. Computer 11 also prepares the integrated information, in a special format for graphic presentation, to the printer plotter 12; to yield the easily interpreted graphic analog output presentations 13 that are shown in detail in FIGS. 2,3,4, and 5.

Figure 2:
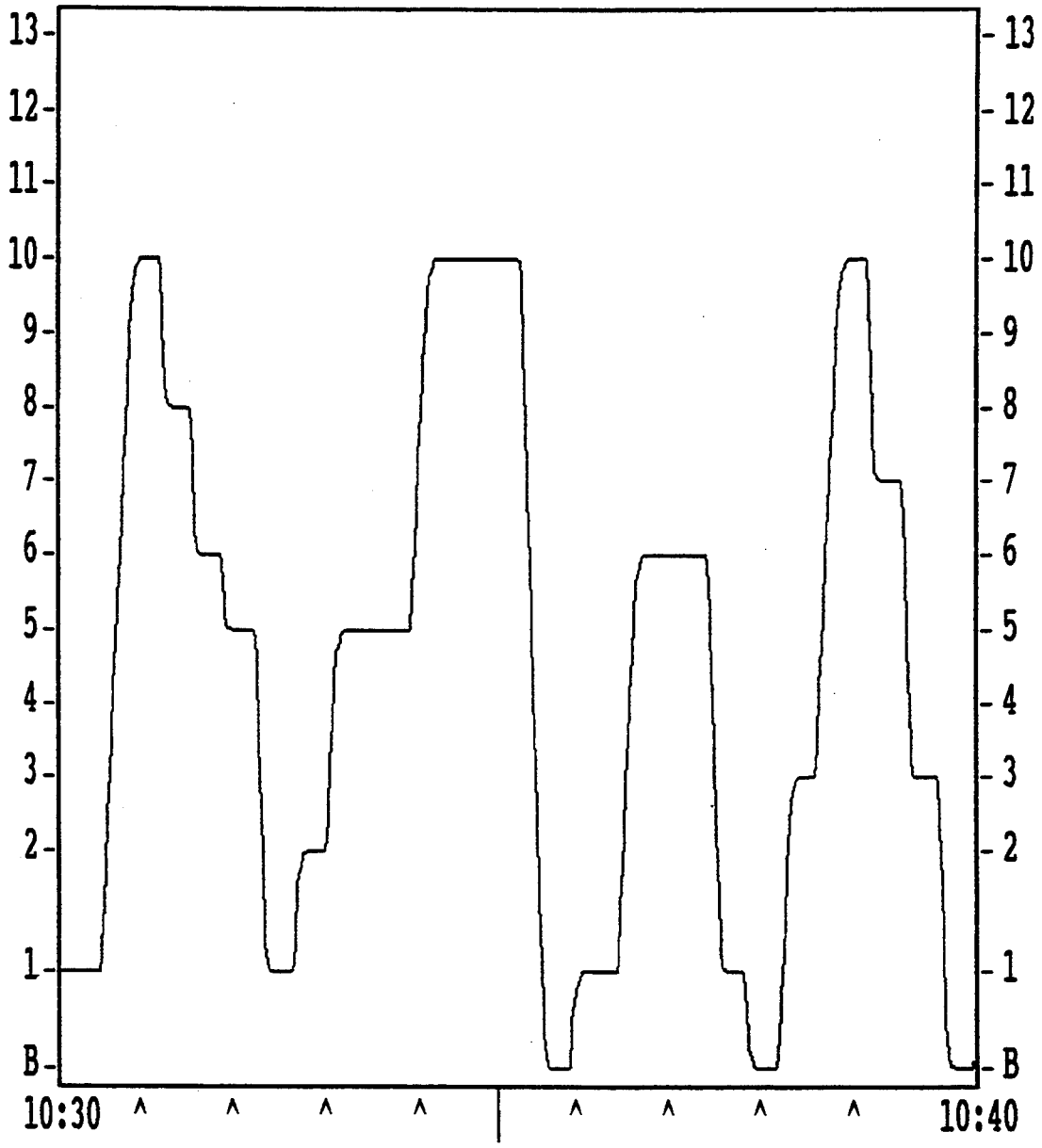
FIG. 2 shows a typical digitally formed graphic presentation, which represents the vertical movements of one elevator, with relation to linear time along the base line.

The typical appearance of a graphic computer presentation is shown in FIG. 2; which represents the movements of one elevator in a 14 story building over a 10 minute time period. This analog display clearly shows the relative position of the elevator on the Y Axis, representing the vertical position in the building; and the X axis, representing the elapsed time.

Notice that the car starts at floor 1 and then goes up to floor 10. It then travels down to 8, then down to 6, also down to 5, and then back down to 1, etc.

The information contained in this graph, FIG. 2, quickly shows the exact position of an elevator at any given time. The graph also shows the exact amount of time the elevator remains at each floor (represented by the length of the horizontal lines). The graphic presentation of FIG. 2 would also identify any operational flaws related to the specific elevator car.

Figure 3:
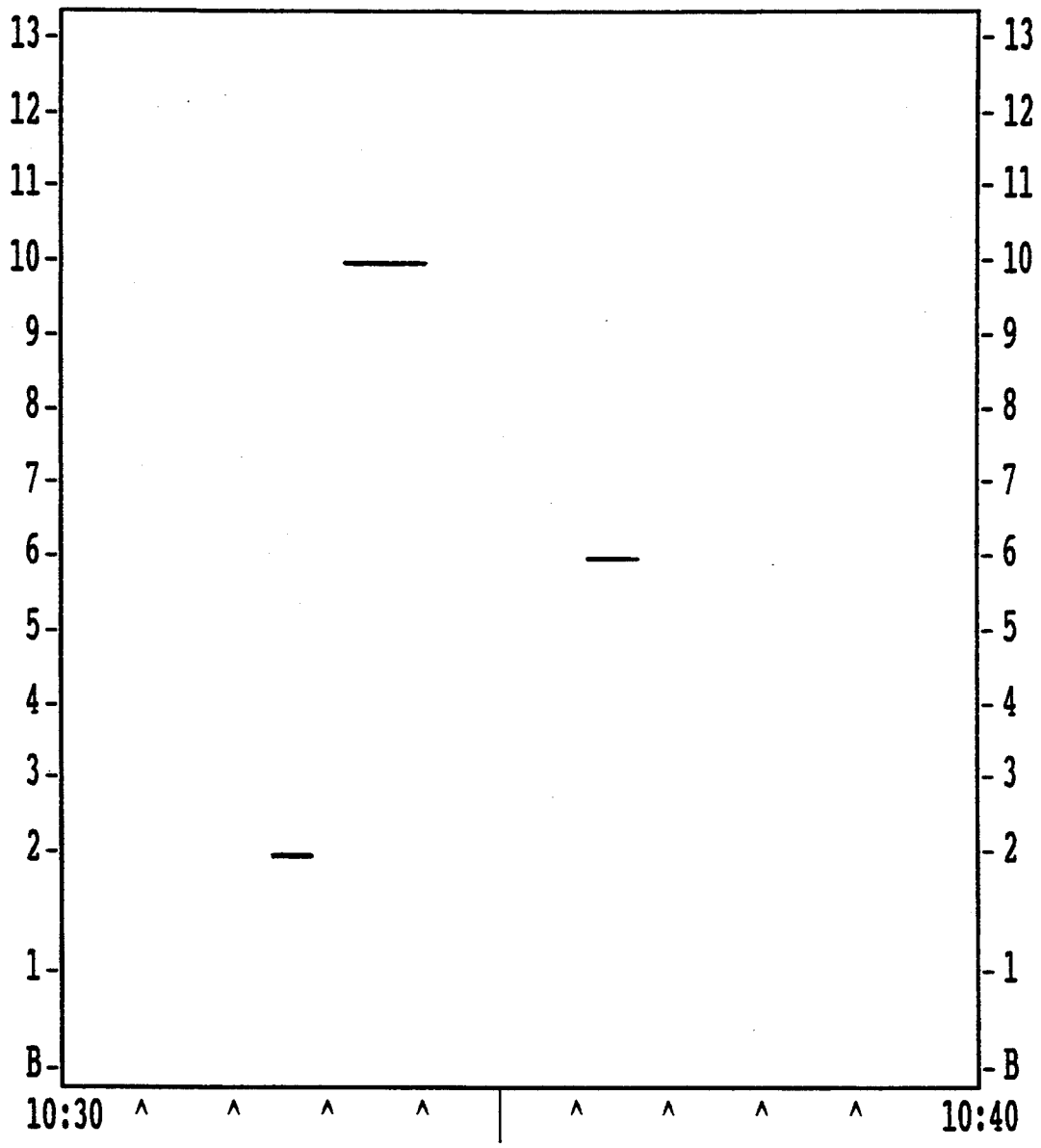
FIG. 3 shows the print-out of a few selected Corridor Calls, which took place in the same building and at the same time as the car movement graph shown in FIG. 2.

FIG. 3 represents a few selected corridor calls which took place in the same 14 story building, and 10 minute time period, as was displayed in FIG. 2. Each horizontal line designates the starting and ending time of each CORRIDOR CALL at its respective floor. UP CALLS are identified by a solid black line; and DOWN CALLS are identified by a dashed line.

Figure 4:
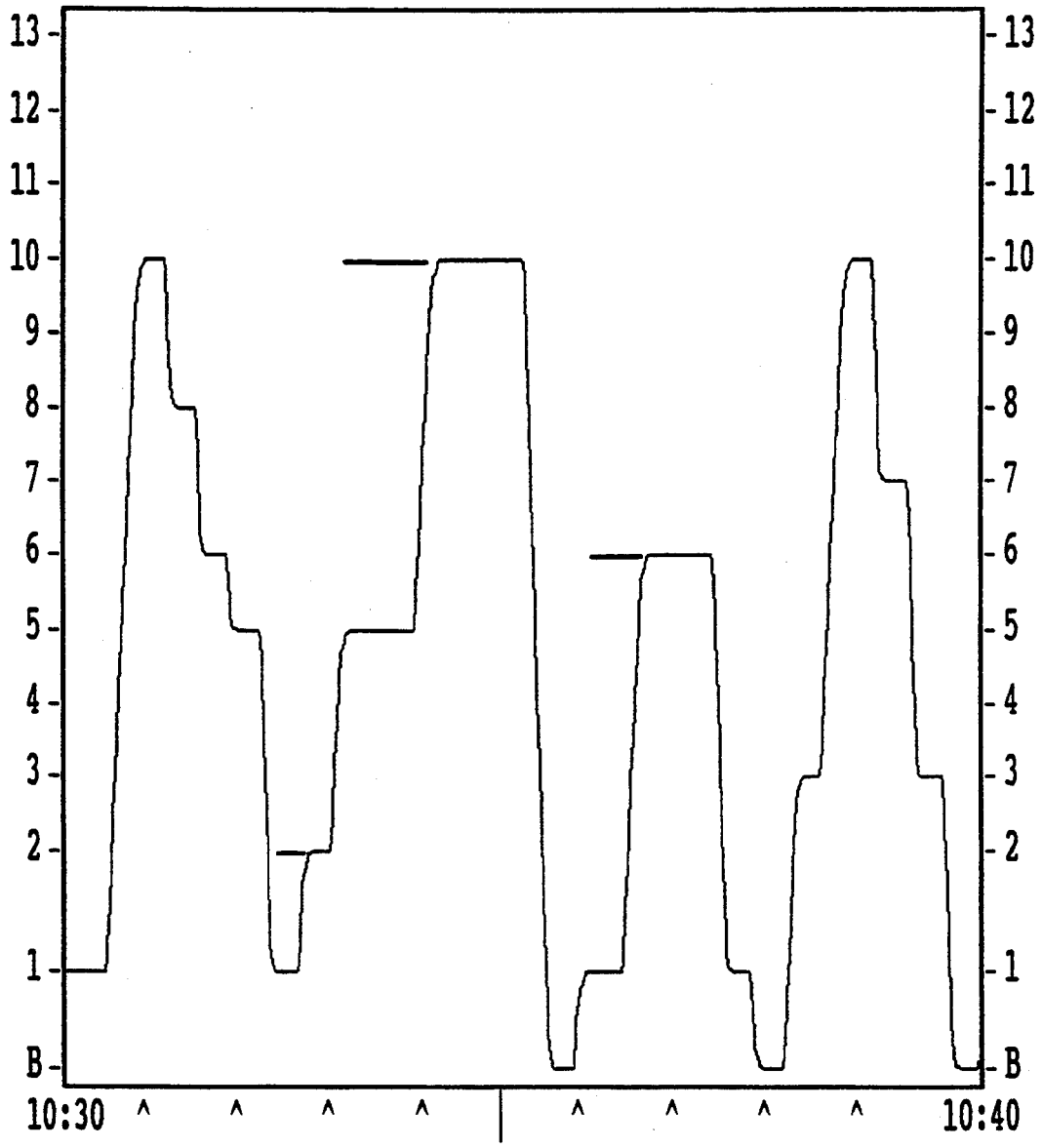
FIG. 4 shows the superimposition of FIGS. 2 and 3; which demonstrates the coincidence of a car arriving at a floor where a Corridor Call is in registration.

The solid line shown in the lower left corner of the display is a 2nd floor UP CALL which originated at approximately 10:32 and lasted approximately 20 seconds. The dashed line located in the upper area of the display is a 10th floor DOWN CALL which originated at approximately 10:34 and lasted approximately 15 seconds. The remaining call is a 6th floor DOWN CALL. These small pieces of information show the distribution of CORRIDOR CALL registrations and their duration.

with reference to FIG. 4, there is a superimposition of FIG. 2 and FIG. 3. This display demonstrates the coincidence of a car arriving at a floor where a CORRIDOR CALL is in registration. In fact, the arrival of the car is what causes a CORRIDOR CALL to terminate.

The 2nd floor UP CALL, as described in FIG. 3, is cancelled by the arrival of the car to the second floor. The car then continues in the appropriate UP direction. The 10th floor DOWN CALL is cancelled upon the arrival of the car to the 10th floor. The car then reverses direction which is appropriate for a DOWN CALL. The 6th floor DOWN CALL is handled in a similar manner to that of the 10th floor DOWN CALL.

The information contained in this type of display is the basic premise for the performance evaluation, Once all of the patterns and signals are superimposed, the trail of information is complete.

SPECIAL ACCELERATION, RATE OF SPEED, AND LEVELLING GRAPHS

Figure 5:
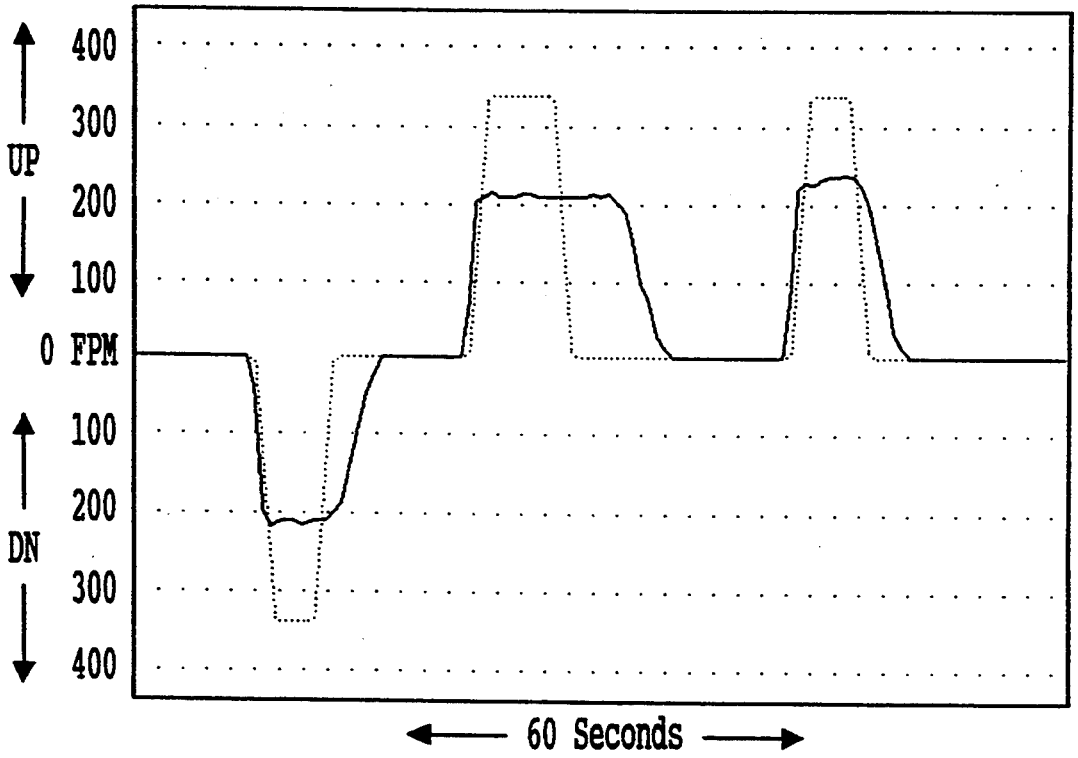
FIG. 5 shows an accelleration curve of a specified elevator car, over a one minute period; with a relatively short time line along the X axis.

The new digital system can be easily converted to a shorter time base for observing finer details of an elevator car performance. With reference to FIG. 5, the acceleration curves of an elevator are depicted over a short one minute period. The display is a graph of a car speed, vertically, along the Y axis, with relation to time along the X axis. The center horizontal position of the display is where a car is stationary, or 0 feet per minute (FPM). The horizontal lines above and below the 0 FPM represent increments of 100 FPM.

The car is stationary at the left side of the display. It then increases its speed in the DOWN direction until it reaches a speed of approximately 210 FPM. It travels at this constant speed for a time, and then it decelerates until it reaches the 0 FPM line. After a few moments, the car accelerates in the UP direction until it achieves a speed of approximately 210 FPM. It then decelerates back down to 0 FPM etc.

The information contained in the graph shown in FIG. 5 shows how fast a car can travel from one point to another; and how much time is being lost (if any) for each floor stop, The light dotted lines show the optimal pattern for this specific type of elevator, The graph reveals that the elevator being tested has several problems; since (1) the car is not running at the rated 350 FPM, (2) the rate of acceleration and deceleration is insufficient and (3) there is unsatisfactory levelling at the stops.

SUMMARY

It has been shown that the new digital recording and graphic presentation system for integrating the performance of many elevator cars, can be easily interpreted by a person with minimal training. The continuous analog presentation, which retains all of the advantages of a computer based digital system, is most akin to the functioning of the human perception system, therefore, the volume of data it presents is in a form that can be easily scanned and analyzed.

FIGS. 2 through 5 are copies of actual readouts of the new system. Although the figures may not meet the strictest requirements for patent drawings, they reveal the quality and simplicity of the digital to analog graphic presentations provided by the new system.

We claim:

1. A digital recording and graphic presentation system which utilizes a portable computer for on-line collection of performance data from elevator systems which have multiple elevator cars that are raised and lowered by rotational drive equipment and operated by a master control; said digital recording and graphic presentation system including a programmed off-line computer and printer/plotter for processing said performance data to provide an easily interpreted analog graphic output presentation for performance analysis; comprising individual rotational tachometers which are coupled to the rotational drive equipment for each of said multiple elevator cars; to provide digital pulse outputs that relate to the actual vertical movement of their respective elevator cars;

a portable on-line computer which is programmed to receive and record said digital outputs from said rotational tachometers;

said portable computer also programmed to receive and record the status of hall calls for the elevator systems in the form of on-off electrical signals from said master control of said elevator systems that have many interrelated elevator cars;

said digital pulse outputs from said rotational tachometers and said status of hall call signals from said master control are recorded by said on-line portable computer and transferred to a programmed oil-line computer which further processes said on-line performance data to produce both time related analog waveforms representing the vertical positions of the cars over time and proximate horizontal line segments representing the time of and between the on and off of the hall call as part of said analog graphic output presentation and;

said analog graphic output presentation having, by its continuous nature, and a common time base, the ability to quickly show the many time related performance problems that may occur in said elevator systems which have many elevator cars that are interrelated by a master control.

* * * * *